US012083376B2

(12) United States Patent
Quarto

(10) Patent No.: US 12,083,376 B2
(45) Date of Patent: Sep. 10, 2024

(54) ADAPTER DEVICE FOR A WEIGHT LIFTING BENCH

(71) Applicant: Andrea Maria Quarto, Portovenere (IT)

(72) Inventor: Andrea Maria Quarto, Portovenere (IT)

( * ) Notice: Subject to any disclaimer, the term of this patent is extended or adjusted under 35 U.S.C. 154(b) by 176 days.

(21) Appl. No.: 17/997,933

(22) PCT Filed: Jul. 1, 2021

(86) PCT No.: PCT/IB2021/055896

§ 371 (c)(1),
(2) Date: Nov. 4, 2022

(87) PCT Pub. No.: WO2022/003611

PCT Pub. Date: Jan. 6, 2022

(65) Prior Publication Data

US 2023/0211201 A1 Jul. 6, 2023

(30) Foreign Application Priority Data

Jul. 2, 2020 (IT) ..... 102020000015997

(51) Int. Cl.
*A63B 21/078* (2006.01)
*A63B 69/00* (2006.01)

(52) U.S. Cl.
CPC ..... *A63B 21/078* (2013.01); *A63B 69/0057* (2013.01); *A63B 2210/50* (2013.01); *A63B 2225/093* (2013.01)

(58) Field of Classification Search
CPC ..... A63B 21/078; A63B 69/0057; A63B 2210/50; A63B 2225/093
See application file for complete search history.

(56) References Cited

U.S. PATENT DOCUMENTS 4,535,985 A 8/1985 Mask
7,753,830 B1 * 7/2010 Marsh ..... A63B 23/03525 482/142
9,248,337 B1 * 2/2016 Humphrey ..... A63B 21/00181
9,433,818 B2 9/2016 Kalleen
(Continued)

OTHER PUBLICATIONS

International Search Report and Written Opinion for Corresponding International Application No. PCT/IB2021/055896, 9 pages, Sep. 17, 2021.

*Primary Examiner* — Zachary T Moore
(74) *Attorney, Agent, or Firm* — Lucas & Mercanti, LLP

(57) ABSTRACT

An adapter device for use with an exercise bench for weight lifting is disclosed. The device includes first and second lateral arms, spaced transversely from each other and arranged externally side by side to the respective lateral edges of the exercise bench, and a main resting platform. The lateral arms and the platform define a supporting surface of the subject's body substantially "U"-or "C"-like shaped integrally adaptable in height and width to the exercise bench. The elevation legs of the supporting surface are configured to support the lateral arms and the platform in an elevated position with respect to a walking plane and substantially placed side by side to said bench surface. In use, the supporting surface receives a lateral part of the subject's torso at the lateral arms and the lower limbs of the latter at the platform.

20 Claims, 12 Drawing Sheets

(56) References Cited

U.S. PATENT DOCUMENTS

| | | | | |
|---|---|---|---|---|
| 9,750,971 | B1 * | 9/2017 | Humphrey | A63B 21/00181 |
| 2004/0023765 | A1 | 2/2004 | Krull | |
| 2014/0087928 | A1 * | 3/2014 | Luedeka | A63B 21/4023 482/130 |
| 2015/0224359 | A1 * | 8/2015 | Kalleen | A63B 21/4029 482/104 |
| 2020/0101342 | A1 | 4/2020 | Lawton | |
| 2023/0048783 | A1 * | 2/2023 | Miller | A63B 21/078 |

* cited by examiner

ADAPTER DEVICE FOR A WEIGHT LIFTING BENCH

CROSS-REFERENCE TO RELATED APPLICATIONS

This application is a 371 of PCT/IB2021/055896, filed Jul. 1, 2021, which claims the benefit of Italian Patent Application No. 102020000015997, filed Jul. 2, 2020.

TECHNICAL FIELD OF THE INVENTION

The present invention relates to a help for sporting activity, at amateur or competitive level, intended to both disabled and able-bodied athletes. In particular, the invention relates to an adapter device for use in association with an exercise bench, flat and in case reclinable, to exercise physically the upper limbs and the torso, with particular reference to the stretching of the upper limbs performed with barbell, handlebars, cables or elastic bands.

BACKGROUND

One of the most practised sporting disciplines in the last decades, both at amateur and competitive level, is the weight lifting performed in lying position on an exercise bench. In particular, the position for performing the lifting provides that the subject's torso is supported on the bench in supine position, whereas the lower limbs are folded laterally to the bench itself, so that the feet result to be rested upon the walking plane and can support the body in the exercise effort and in guaranteeing stability and power during execution.

This discipline is performed even by disable athletes and it is recognized by CONI as Paralympic specialty. It is exerted, in particular, by subjects without mobility of the lower limbs, for example due to partial or total paralysis, or unilateral, bilateral, trans-tibial and trans-femoral amputation. For the above-mentioned use cases, the assumption of the above-mentioned standard posture which provides to place the lower limbs resting laterally is not practicable or however it appears to be not effective in providing a safe and adequate support during exercise. For this reason, dedicated benches were developed, which are larger and longer than those usually available in the workout gyms, so as to allow resting in a lying position not only the torso, but even the complete pelvis and the lower limbs. The execution of the exercise on the above-mentioned dedicated bench, or with a body wholly lying in supine position, is practised also by able-bodied athletes, as complementary to the classical execution, so as to cause different stimula and muscle activation, so as to guarantee a performance progression.

However, since it is a not standard tool, and however reserved to a specific target of athletes, it generally results to be very expensive and, even as a consequence of this, not very widespread. Such circumstances prevent most parathletes from training in the common gyms. The parathletes then have to address to specialized structures, not very widespread on both national and International territory (with particular reference to the developing countries where all the more reason the costs to be supported become prohibitive), or to use extemporaneous and improvised supports inadequate to the purpose which expose them to high risk of injury, not being able to guarantee an adequate stability and safety in the exercise execution.

U.S. Pat. No. 4,535,985 describes a polyfunctional exerciser for weight lifting, which can be used to perform exercises identified as "power hip exercise", "power leg exercise" and "hack squat exercise", corresponding to different postures of the athlete with respect to the equipment itself.

The machine described in this document comprises a frame defined by crossbeams and uprights, whereon a weight support is applied sliding along two counter-lateral oblique guides. The equipment further includes an extractable bench which comprises two lateral portions for supporting the athlete's back and an extractable central portion, apart from a head support.

U.S. Pat. No. 4,535,985 does not describe an adapter device of an exercise bench having two lateral portions and a central platform defining a "U"- or "C"-like shaped unitary supporting surface. Moreover, the head supporting surface of U.S. Pat. No. 4,535,985 is not suitable to receive as rest the lower limbs.

Moreover, the equipment of U.S. Pat. No. 4,535,985 does not configure as adapter, but as independent machinery for the exercise of the lower limbs. Such machinery, if used in the mode providing lying supine on the resting plane, support only the torso so as to be able to perform exercises related to the lower limbs by pressing on a plate constrained to sliding tracks whereon the load is positioned.

SUMMARY OF THE INVENTION

The technical problem placed and solved by the present invention is then to obviate the drawbacks mentioned above with reference to the known art.

Such problem is solved by an adapter device according to claim 1.

Preferred features of the present invention are set forth in the depending claims.

The invention provides an adapter device suitable to be used with a common flat and in case reclinable weight lifting bench, which enlarges and lengthen the resting surface thereof available for supporting the sportsman's body, in particular at the level of torso, pelvis and lower limbs, by guaranteeing an effective execution in total safety.

In particular, the adapter device of the invention is configured to be arranged side by side to an exercise bench having a supporting upper surface with substantially rectangular plan, by integrating the extension thereof, in particular both width and length. This is obtained by means of longitudinal and transverse auxiliary supporting surfaces which define as a whole a "U"-like profile at least partially circumscribed on three sides to the "standard" bench. Such auxiliary surfaces are indeed arranged laterally both on the long side of the bench and on the short side farer from the application of the work load by means of barbell, handlebars, elastic bands or cables provided in performing the exercise, that is at the lower limbs.

The adapter device of the invention is suitable to a simple implementation and low costs, giving the possibility to all parathletes to train in all gyms providing a weight or fitness activity, by avoiding barriers of any type and by guaranteeing the athlete safety. The proposed device allows a training with comfort and safety, for any injury involving the lower limbs or the pelvis.

The device is suitable to be used both in amateur and competitive field, by guaranteeing in particular the approach of disabled people to sport and fitness in a perspective of well-being and daily independence, by promoting at the same time inclusion and aggregation. In the paralympic field, the device makes sport of Paralympic bench usable on wide scale.

Other advantages, features and use modes of the present invention will result evident from the following detailed description of some embodiments, shown by way of example and not with limitative purpose.

BRIEF DESCRIPTION OF THE FIGURES

The figures of the enclosed drawings will be referred to, wherein.

DETAILED DESCRIPTION OF PREFERRED EMBODIMENTS

Various embodiments and variants of the invention will be described hereinafter, and this with reference to the above-mentioned figures.

Analogous components are designated in the different figures with the same numeral reference.

In the following detailed description, additional embodiments and variants with respect to embodiments and variants already treated in the same description will be illustrated limitedly to the differences with respect to what already illustrated.

Moreover, the different embodiments and variants described hereinafter are subject to be used in combination.

Figure 1:
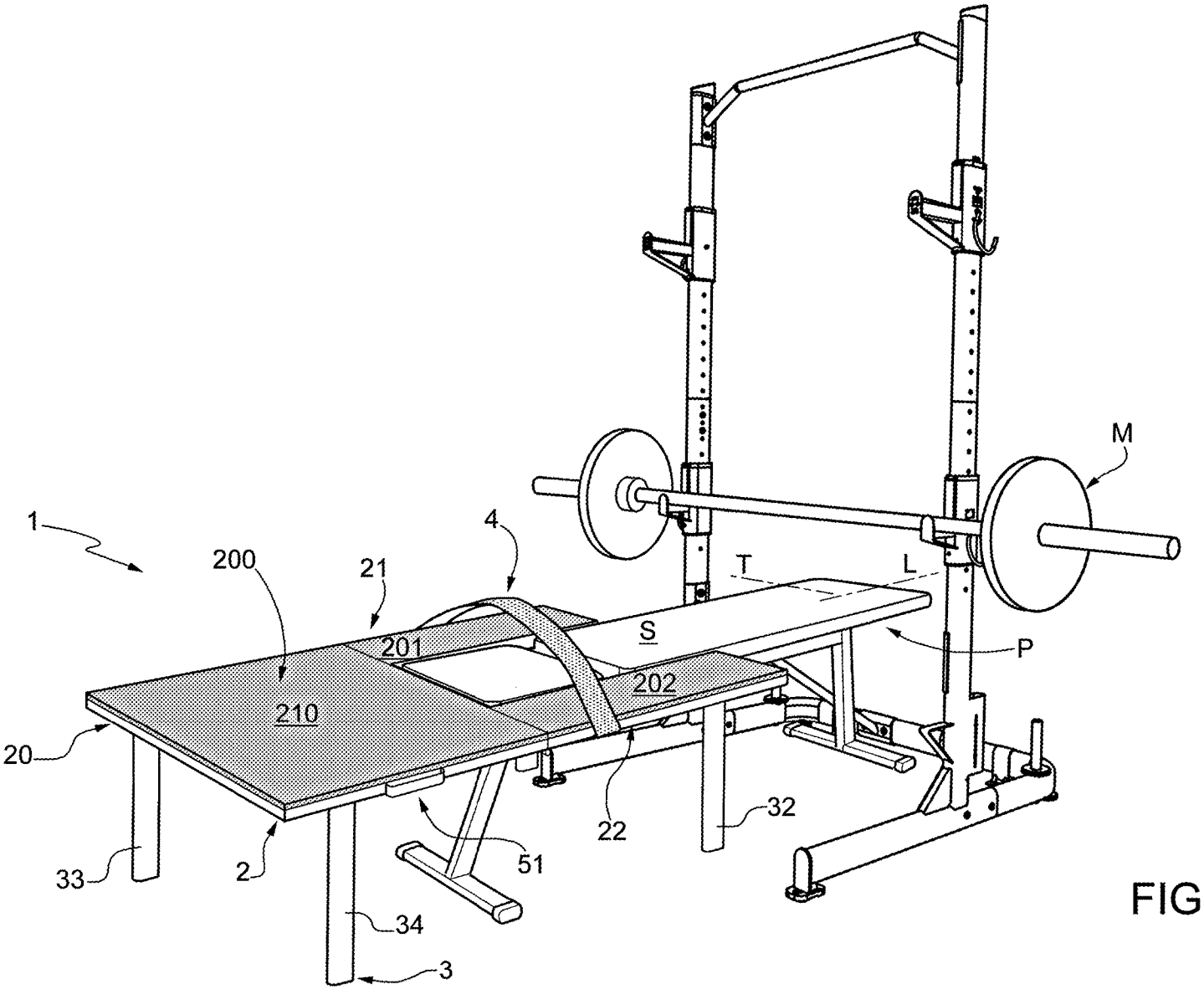
FIG. 1 shows a front perspective view of a preferred embodiment of the adapter device according to the present invention, represented in association with a weight lifting bench.
Figure 2:
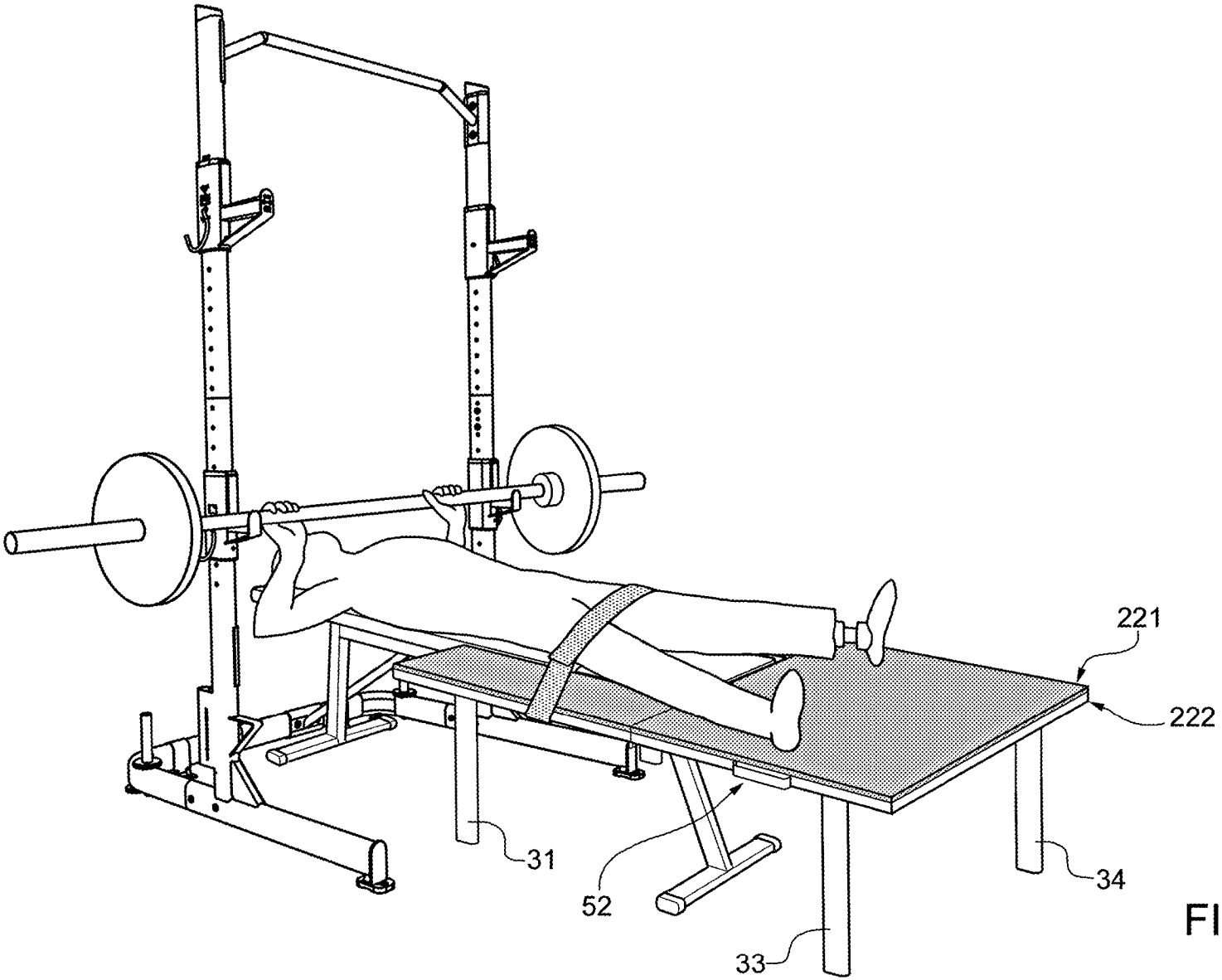
FIG. 2 shows a front perspective view of the device of FIG. 1, during the use by a sportsman.

By firstly referring to FIGS. 1 and 2, an adapter device according to a preferred embodiment of the invention is designated as a whole with 1.

The device 1 is configured to be used in association with an exercise bench, the latter designated with P, for weight lifting. In particular, such bench, as it is known in the art, has a supporting surface S configured to receive part of the body of a sporting subject in a lying position, typically supine position, as exemplified in particular in FIG. 2. The supporting surface S typically has, a plan rectangular profile. For the bench P then two directions, orthogonal to each other, can be defined defining the position of the subject who uses the bench itself, that is a longitudinal direction L corresponding to the height of the lying subject and to the long sides of the bench and a transverse direction T corresponding to the width of the subject's body and to the short sides of the bench itself.

In said lying position, the subject lifts a barbell M carrying weights at the ends, as it is known in the art.

The adapter device 1 comprises a main body 2 and elevation means 3 to keep the main body itself in elevation with respect to a walking plane.

The main body 2 is formed by a first and a second lateral arm, respectively 21 and 22, mainly extending according to the longitudinal direction L and spaced transversely from each other. The arms 21 and 22 are configured to arrange, in use, each one externally placed side by side to a respective longitudinal lateral edge, or long side, of the exercise bench, preferably extending for a portion of the length thereof. Such arms 21 and 22 define longitudinal appendixes of a main platform 20 of the main body 2 itself. The latter mainly extends according to the longitudinal and transverse directions L and T and it is configured to arrange, in use, side by side to an end transverse edge of the exercise bench, or short side thereof.

Each arm 21 and 22 extends starting from the main platform 20 with a respective external longitudinal longitudinally aligned, or substantially aligned, with a corresponding external longitudinal edge of the platform 20. In this way, the bench P inserts in the longitudinal direction between the arms 21, 22 and abuts at an internal transverse edge of the platform 20.

The main body 2, and in particular the arms 21 and 22 and the platform 20, define a supporting surface 200 of the subject's body, which, thanks to the overall arrangement of the arms 21, 22 and of the platform 20, is substantially "U"-or "C"-like shaped. In particular, in FIG. 1 the portion of such surface defined by the platform 20 is designated with 210 and the portions defined by the arms 21 and 22 with 201 and 202, respectively.

In use, the supporting surface 200 receives as rest a lateral part of the subject's torso at the lateral arms 21 and 22 and the lower limbs of the latter, for their whole extension, at the platform 20, as exemplified in FIG. 2.

The main body 2 is advantageously implemented in two layers of material, vertically placed side by side, in particular a first ergonomic layer 221 interacting with the subject's body, in particular made of sponge with leather coating, foam rubber, neoprene or other natural or synthetic material, and a second structural layer 222, in particular made of wood or metal, for example steel.

In embodiment variants an additional coating made of anti-slipping material (for example eco-leather) can be used to avoid damages to the padding during use and to define the external aspect.

Generally, the upper portion of the arms and of the platform defines a supporting, that is resting, floor for the body of the athlete who performs the exercise.

The arms 21 and 22 and the platform 20 can be implemented integral or in-built to each other or, as in the herein described embodiments, jointed mutually to allow folding the adapter device.

The elevation means 3, as said, keeps the supporting surface 200 at vertical distance, that is elevated, with respect to the walking plane and substantially vertically side by side to the bench surface S, that is substantially at the same level of the latter. In the present example, the means 3 comprises four supporting legs or uprights, designated respectively with references 31 to 34. The uprights 31 and 32 are arranged transversely spaced apart and longitudinally aligned, each one under a respective arm 21, 22. The uprights 33 and 34 are arranged longitudinally spaced apart from the respective uprights 31 and 32 and transversely spaced apart from each other, under the platform 20.

The elevation means 3 can be too made of metal, in particular made of steel. Embodiment variants can provide a different number of uprights, for example equal to five or six.

In the present embodiment example, the device 1 even comprises transportation means, for example in the form of gripping means such as lateral handles 51 and 52. The latter are arranged, in the represented example, aligned at longitudinal edges of the platform 20.

Figure 3:
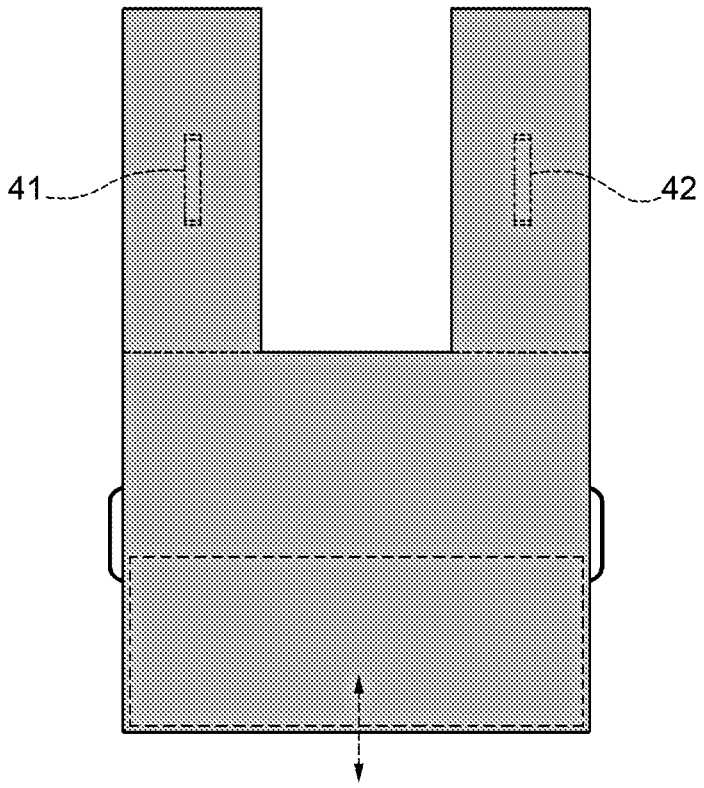
FIG. 3 shows a top plan view of a preferred embodiment variant of the device of the invention.

Preferably, the device 1 comprises means for stabilizing the subject's body, in particular one or more transverse belts 4 configured to wound pelvis and/or lower limbs. Advantageously, the belt(s) 4 can slide in longitudinal slots obtained below the main body 2, the latter exemplified in FIG. 3 as a pair of slots associated each one to a respective arm 21, 22 and herein designated with 41 and 42.

Figure 4A:
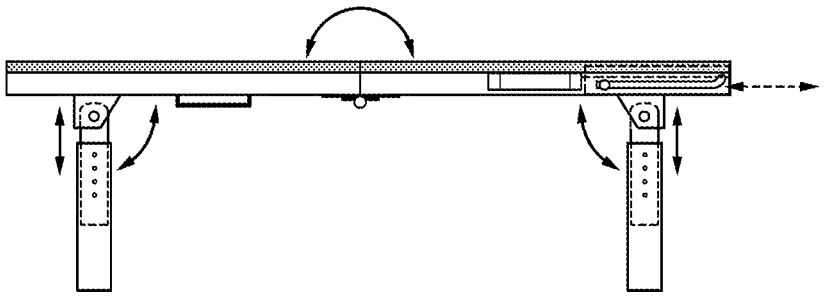
FIGS. 4A and 4B show each one a side view of a preferred embodiment variant of the device of the invention, in a respective operating configuration.
Figure 4B:
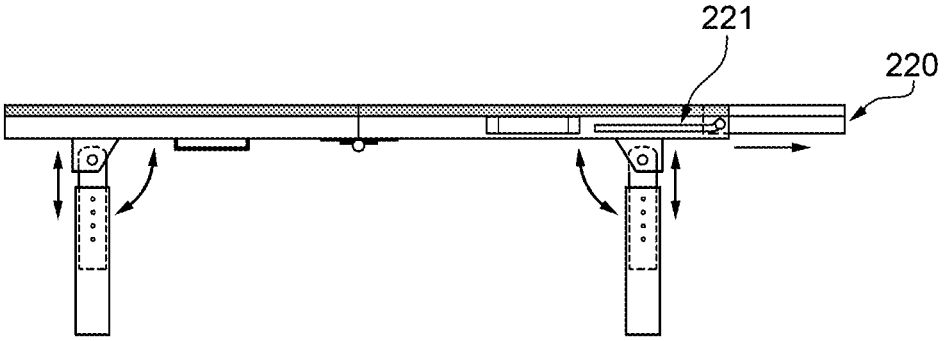

By referring to FIGS. 4A and 4B, based upon a preferred embodiment variant the main body 2 has an adjustable longitudinal extension, in particular at the level of the platform 20. The latter has an appendix 220 selectively extractable indeed in the longitudinal direction by means of a pin and shaped guide system 221 known on itself and schematically represented in the above-mentioned figures.

Still by referring to FIGS. 4A and 4B, based upon a preferred embodiment variant the elevation means 3 has adjustable height, in particular by means of a telescopic construction.

According to a preferred embodiment variant, the device 1 is foldable, at the level of the main body 2 and/or of the elevation means 3.

In particular, also with reference to FIGS. 5As and 5B, the uprights 31-34 can be each one revolvingly connected to the main body 2 so as to be able to assume a folded configuration, or having minimum encumbrance, below the main body 2 itself, in which the upright extends in the longitudinal direction.

Moreover, the main body 2 can be foldable at a connection between each arm 21 and 22 and the platform 20. Such connection is shown purely schematically and by pure way of example in the drawings, its implementation being within the comprehension of the person skilled in the art.

Figure 5A:
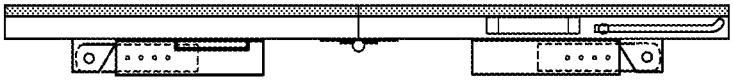
FIGS. 5A and 5B show each one a side view of the device of FIGS. 4A and 4B, in a respective configuration having minimum encumbrance.
Figure 5B:
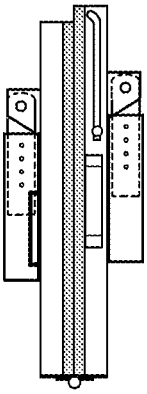

In this way, the device 1 can assume one or more configurations having minimum encumbrance, for example for storage or transportation, exemplified in the views of FIGS. 5A and 5B.

An embodiment variant can provide a system for anchoring between the two portions of the device when this is closing, so as to avoid the adaptor opening during transportation when it is under the condition of having minimum encumbrance.

By pure way of example, in specific embodiments the device 1 can have overall longitudinal length of about 125 cm, extendable as far as about 135 cm.

The platform 20 can have overall width equal to about 63.5 cm.

The main body 2 can have thickness equal to about 6 cm, for example with an ergonomic layer 221 of about 2 cm and a structural layer 222 of about 4 cm.

Each arm 21, 22 can have transverse width equal to about 16 cm.

The height of the resting surface 200 from ground can be of about 40 cm, which can be lifted up to about 50 cm.

An additional embodiment of the adapter device according to the invention will be now described with reference to FIGS. 6A to 11B. The description will mainly relate to the variants or integrations with respect to what illustrated above.

Figure 6A:
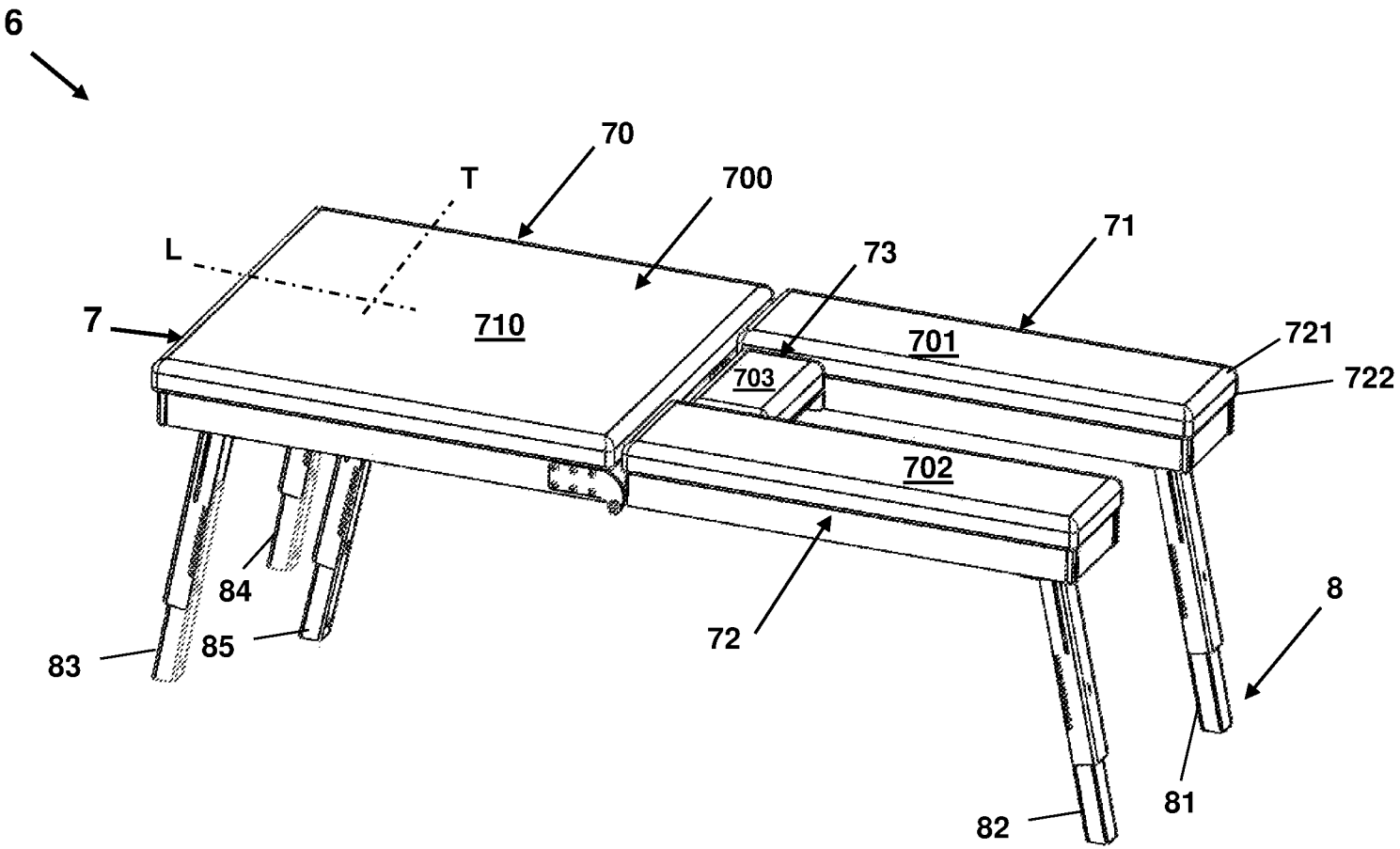
FIGS. 6A and 6B relate to another preferred embodiment of the adapter device according to the present invention, by showing each one a respectively side and front perspective view thereof.
Figure 6B:
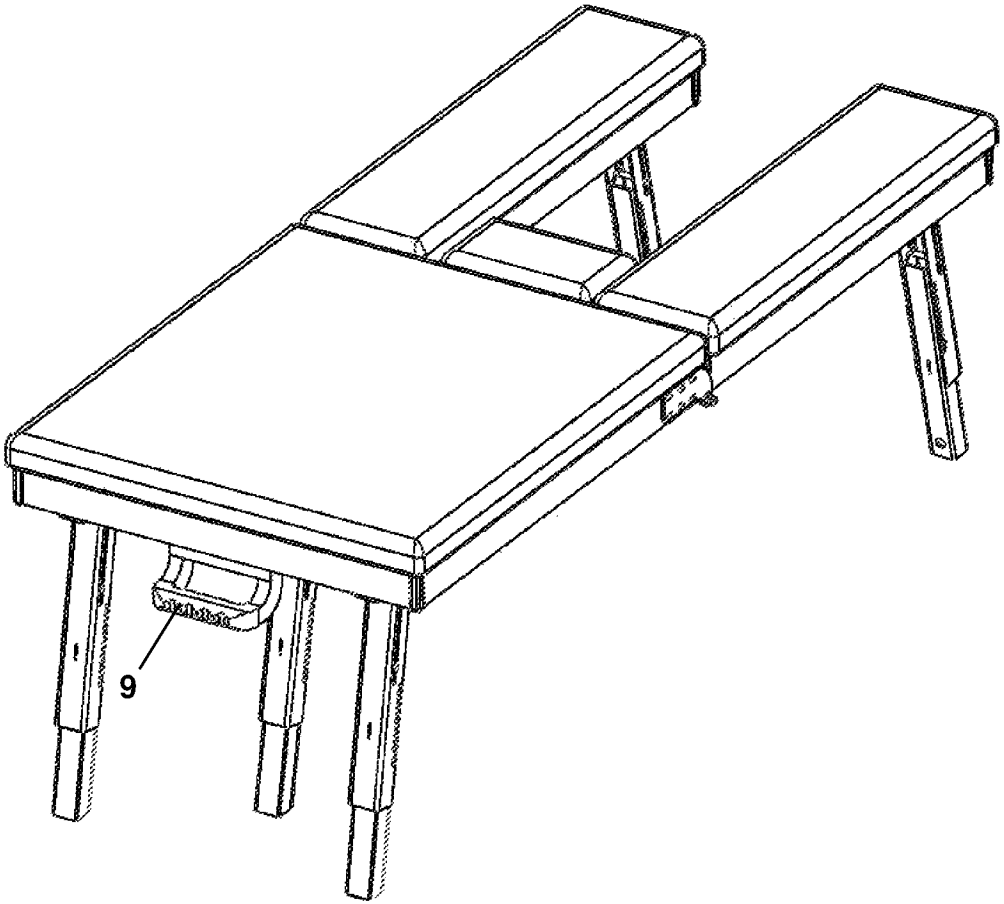
Figure 6C:
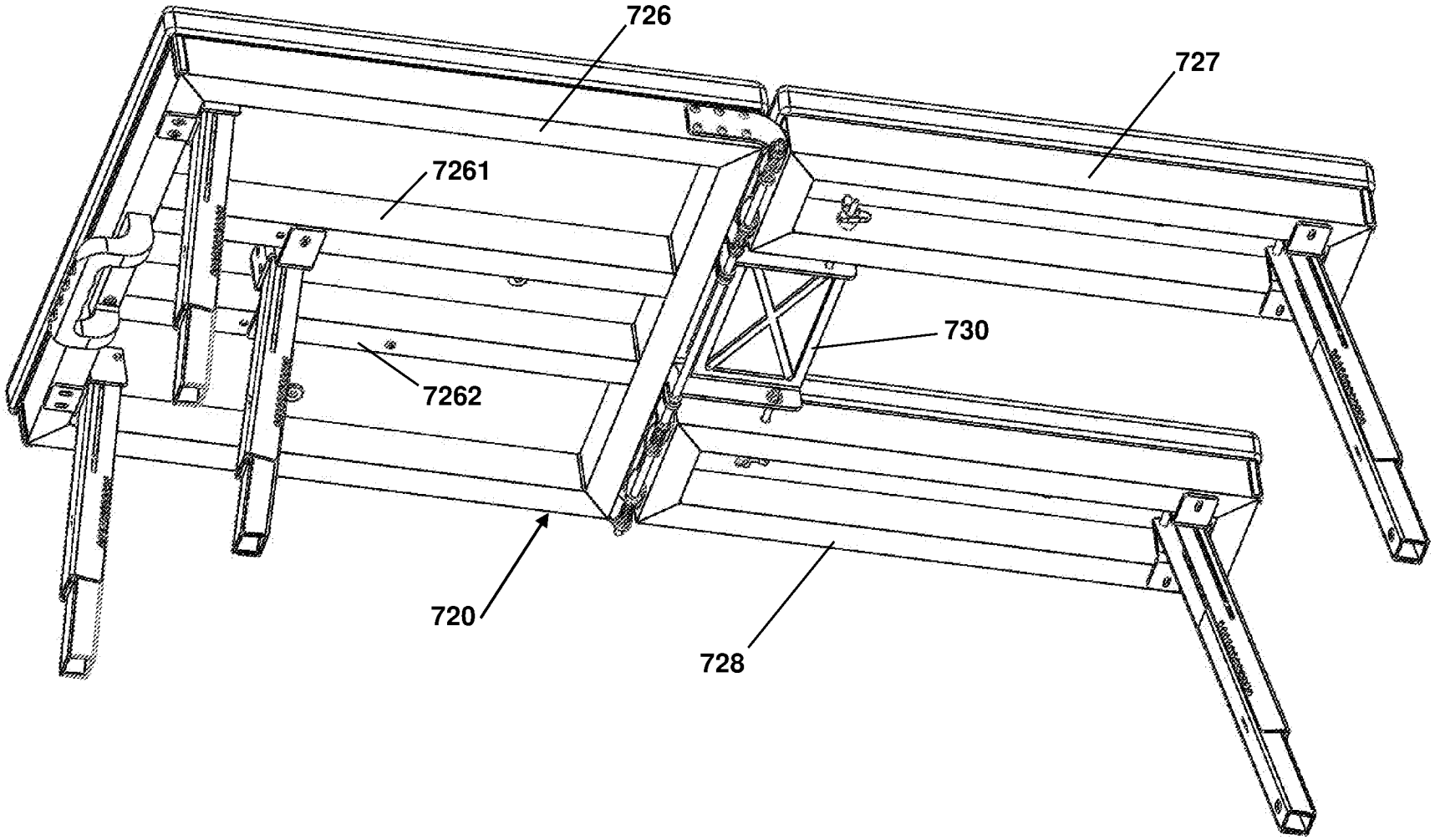
FIG. 6C relates to an embodiment variant of the device of FIG. 6A, by showing a perspective bottom view.

By firstly referring to FIGS. 6A to 6C, the adapter device of the present preferred embodiment of the invention is designated as a whole with 6.

The device 6 is configured to be used in association with an exercise bench, analogously to what already exposed.

The adapter device 6 comprises a main body 7 and elevation means 8 to keep the main body itself at a predetermined height with respect to a walking plane.

The main body 7 is formed by a first and a second lateral arm, respectively 71 and 72, mainly extending according to the longitudinal direction L and spaced transversely from each other. The arms 71 and 72 are configured to arrange, in use, each one externally side by side to a respective longitudinal lateral edge, or long side, of the exercise bench, as already illustrated. Such arms 71 and 72 define longitudinal appendixes of a main platform 70 of the main body 7 itself. The latter mainly extends according to the longitudinal and transverse directions L and T and it is configured to arrange, in use, side by side to an end transverse edge of the exercise bench, or short side thereof, still according to what already illustrated.

The main body 7, and in particular the arms 71 and 72 and the platform 70, define a supporting surface 700 of the subject's body, which, thanks to the overall arrangement of the arms 71, 72 and of the platform 70, is substantially "U"-or "C"-like shaped. In particular, in FIG. 6A the portion of such surface defined by the platform 70 is designated with 710 and the portions defined by the arms 71 and 72 with 701 and 702, respectively.

In use, the supporting surface 700 receives as rest a lateral part of the subject's torso at the lateral arms 71 and 72 and the lower limbs of the latter, for their whole extension, at the platform 70, as already exemplified.

The surface 700 is then part of a supporting, or resting, floor for the body of the athlete defined by the arms 71 and 72 and by the platform 70.

The implementation of the main body 7 as comprising two layers implementing a supporting floor for the athlete's body, herein designated with 721 and 722, has been already illustrated with reference to the preceding embodiment.

Moreover, in the present embodiment the main body 7 further comprises a carrier frame, preferably made of metal, placed below said floor and designated with 720. The frame 720 substantially defines the polygonal shape of the main body 7 of the device 6 and advantageously it is implemented by means of a plurality of bars, crossbeams, tubes or metal profiles, as better visible in FIGS. 6C and 8A.

In particular, based upon the embodiment example shown in said figures the frame 720 consists of three structures implemented with welded tubes made of aluminium. In the shown embodiment, it is possible to distinguish three structures, as illustrated hereinafter.

A first structure 726, having greater sizes, is intended to the connection with the part of the previously mentioned supporting floor corresponding to the platform 70. Apart from the peripheral tubular elements defining the encumbrance thereof, the structure 726 is further provided with additional two reinforcement, or stiffening, elements, longitudinal in the central portion, designated with 7261 and 7262, advantageously arranged symmetrically with respect to a longitudinal centre plane of the device 6.

Two additional structures, generally identical and designated with 727 and 728, respectively, are arranged symmetrically with respect to the longitudinal centre plane and each one corresponds to a respective portion of floor defined by the arms 71 and 72.

In the present embodiment, the main body 7 further comprises a central arm, or cushion, 73, interposed between the two arms 71 and 72 and approached to the platform 70. The central arm 73 has the same above-exemplified construction of the other elements 70, 71 and 72 of the main body, but not frame elements 720 placed therebelow. The element 73 can have its own carrier framework, or small frame, 730, preferably made of metal too.

In use, the element 73 interfaces with the bench end near the lumbar region and it can define a portion 703 of supporting surface.

In the present example, the elevation means 8 comprises five supporting legs or uprights, designated respectively with references 81 to 85, each one revolvingly constrained to the frame 720 according to a transverse rotation axis and in particular parallel to the short side of the device 6, that is of the bench used together therewith.

The arrangement of the legs 81-84 is analogous to the one already described with reference to the preceding embodiment. The device 6 further comprises, as said, a fifth leg 85, arranged at the platform 70 in longitudinally retracted position with respect to the periphery thereof and transversely centred. The leg 85 can be constrained to the two stiffening elements 7261, 7262 arranged in the central portion of the structure 726. The three legs 83, 84 and 85 are then constrained to the first structure 726 of the frame 720.

The two legs 81 and 82 are constrained each one to a respective structure 727, 728 of the frame 720.

On each one of the structures 726, 727 and 728 additional connecting means can be provided, for example in form of seats or holes, for re-positioning the legs in case of specific assembly needs, for example linked to the configuration of the exercise bench.

The proposed configuration for the elevation means 8 provides great stability to the structure of the device 6 as a whole.

Figure 11B:
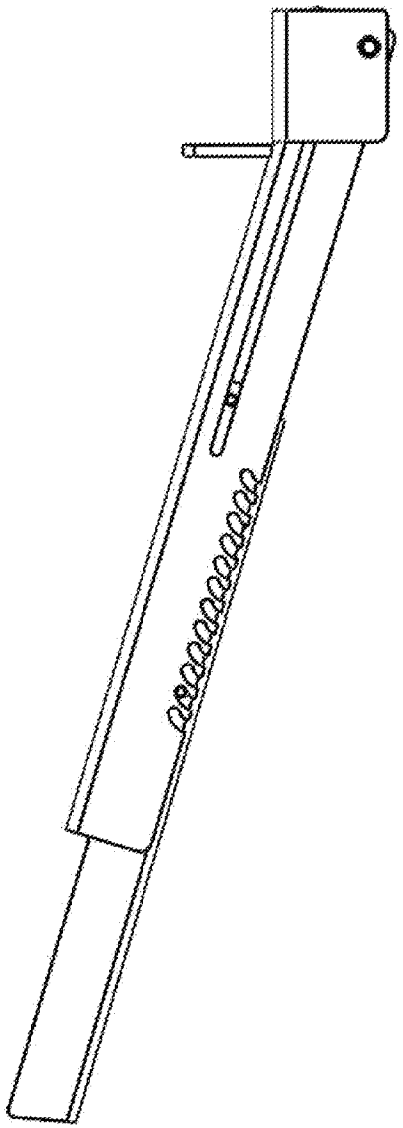
FIGS. 11A and 11B show each one a perspective view of an embodiment variant of a supporting leg of the device of FIG. 6A, respectively in a phase for preparing locking at a selected height and in locked configuration.
Figure 11A:
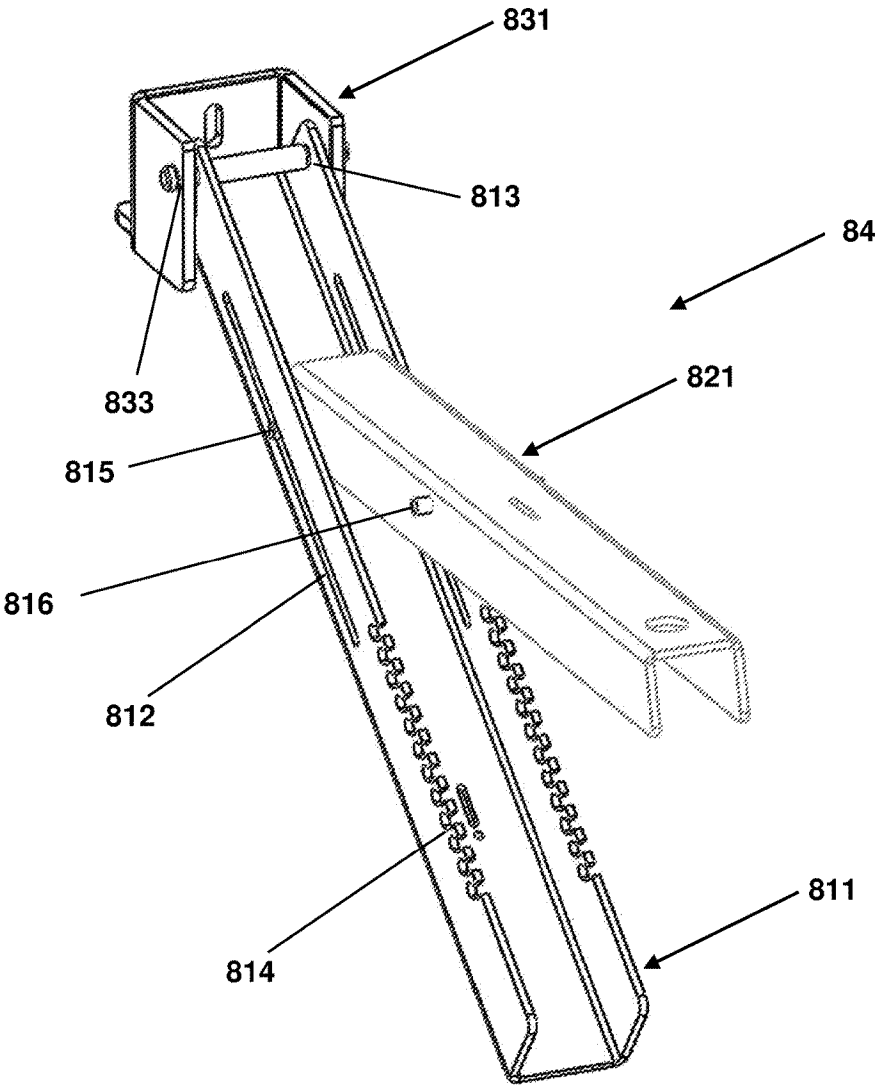

As shown in greater detail in FIGS. 11A and 11B, referred by way of example to the leg 84, each leg 81-85 can be implemented by means of a pair of elongated elements substantially C-like shaped and mutually coupled. A first element 811 with a "C"-like profile has two elongated symmetrical slots, or guides, 812, an upper pair of coaxial holes 813 and a series of compartments with circular, or shaped, profile 814 which extends as far as the edge of the component by creating a kind of indentation. A second element 821 has smaller sizes than those of the element 811, so as to be able to be embedded inside the latter, in particular when the leg has to be folded below the frame 720.

A third stirrup-like element 831 connecting to the frame 720 is further provided, associated to the first element 811 at and end thereof placed side by side, in use, to the frame itself. The element 831 too is provided with two coaxial holes 833 for the insertion of a pin which engages with the coaxial holes 813 of the element 811. Such configuration implements the above-mentioned revolving (rotoidal) coupling which allows each leg to fold below the frame 720 for storage or transportation, as described shortly.

Each leg 81-85 has variable, that is adaptable, configuration. In particular, the side slots 812 allow a pin 815, which engages with a pair of holes obtained on the element 821, to slide inside thereof, by implementing a coupling with telescopic shape between the elements 811 and 821. In this way it is possible to extend/shorten the leg. The indentation obtained on the element 811 instead engages with a high pin 816, in turn integral to the element 821. In this way it is possible to lock in position the two elements 811, 821 of the leg at a wished extension. The indentation is created to guarantee discrete positioning, for example at ranges of 10 mm. This allows the athlete to adjust the height of the device 6 relatively to that of the bench in use.

Embodiment variants can provide a different shape coupling between the elongated elements 811 and 821 with the purpose of implementing the wished adjustability of height/length.

Figure 8A:
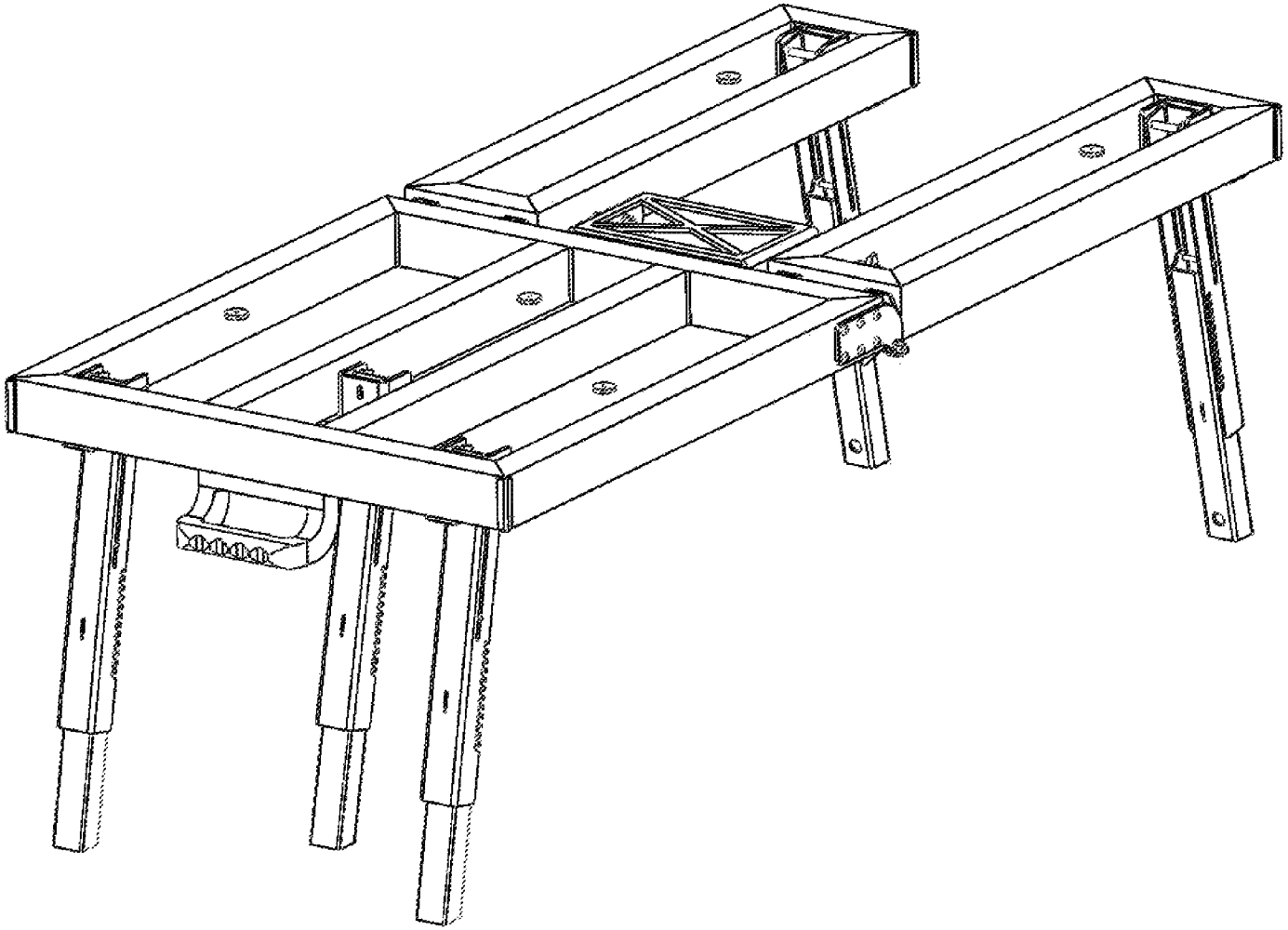
FIG. 8A shows a perspective view of an embodiment variant of the device of FIG. 6A, wherein for the sake of clarity upper covering elements, that is elements defining a resting floor for the athlete's body, have been removed.
Figure 8B:
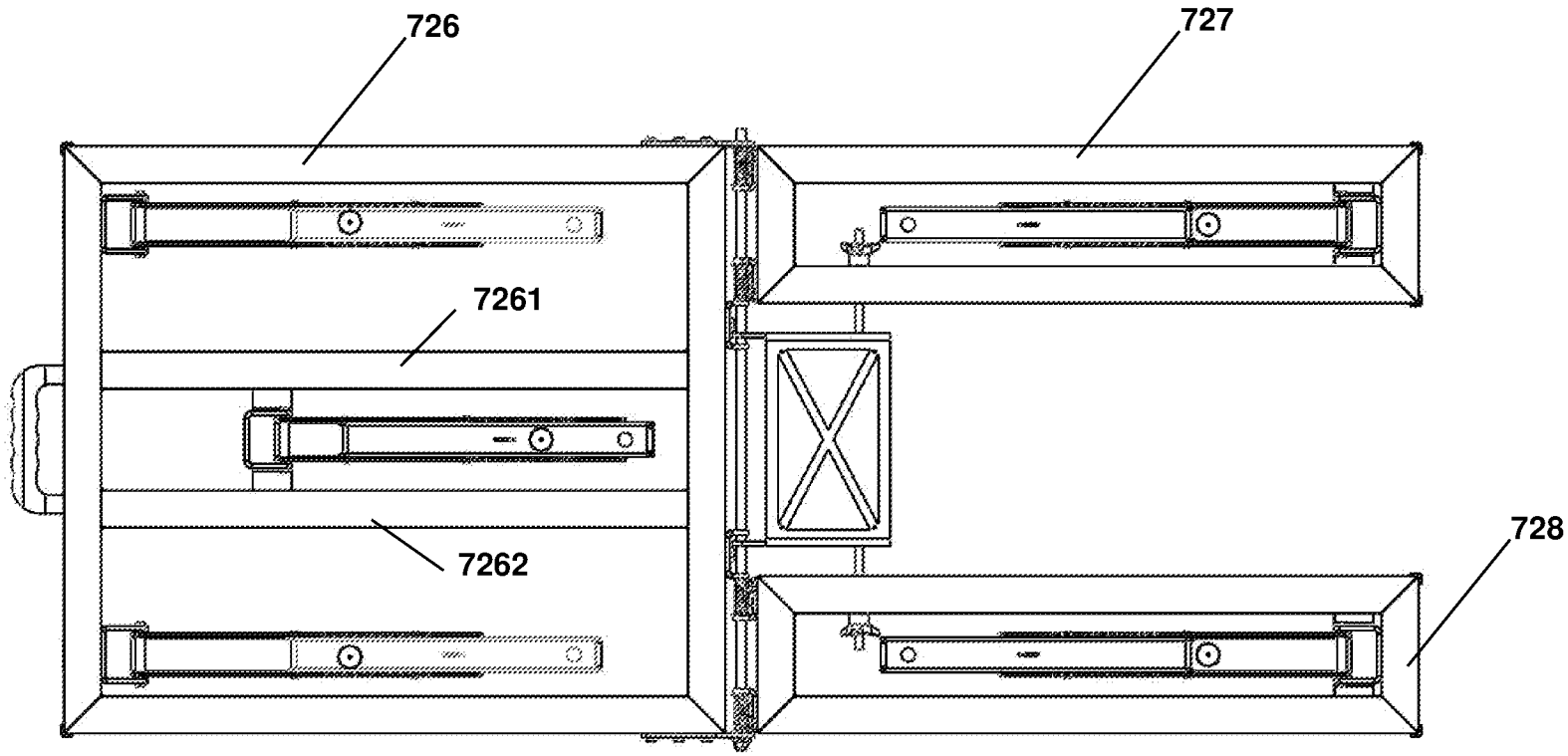
FIG. 8B shows a plan bottom view of an embodiment variant of the device of FIG. 6A, in a configuration wherein the legs of the device itself are folded under the resting floor.
Figure 9:
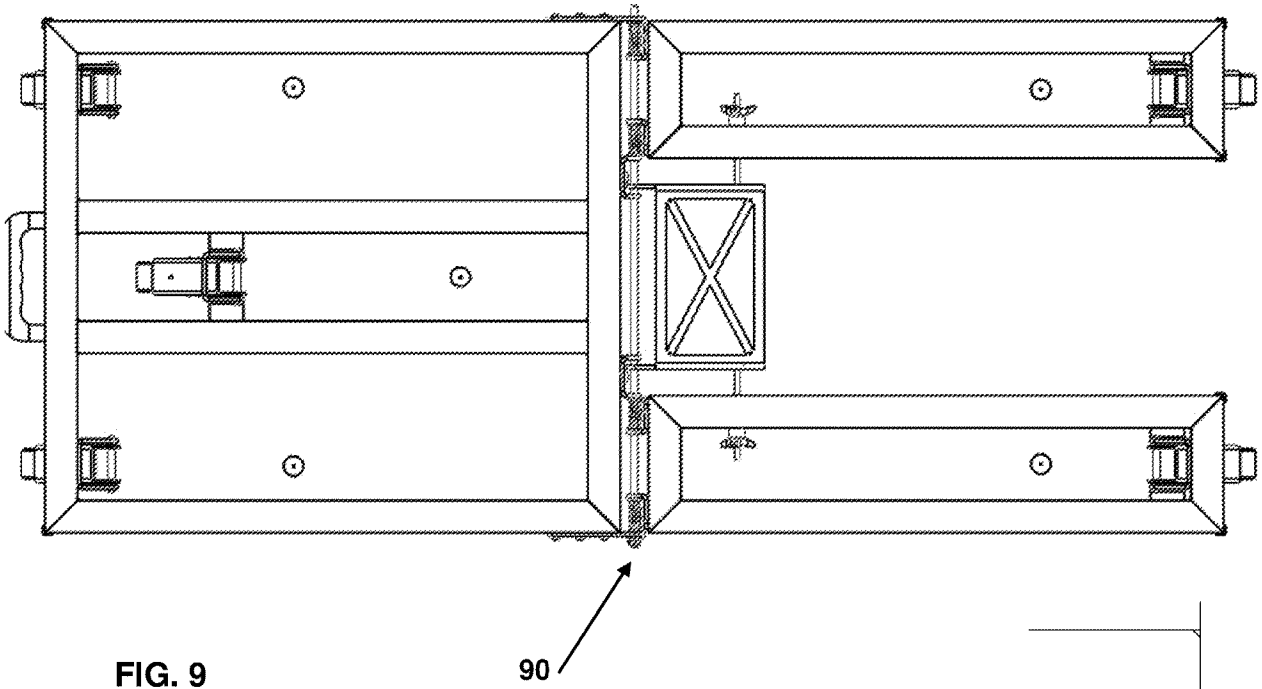
FIG. 9 shows a plan bottom view of a frame of an embodiment variant of the device of FIG. 6A, wherein for sake of clarity the supporting legs have been omitted.

As shown in FIG. 8B, advantageously, the structure with discrete elements of the frame 720 and the relative sizes and configuration thereof and of each leg 81-85 allow the legs themselves to be folded below the frame 720 and to be received within the overall thickness of the latter, without projecting on the lower side. In other words, the folded legs are housed in residual compartments between the elements constituting the frame 720, by positioning directly side by side on the floor defined by the platform 70 and by the arms 71 and 72.

In this way, an effective optimization of encumbrances is implemented.

In order to keep the legs placed side by side to the elements 70-72 in the herein considered folded configuration, keeping means, for example of magnetic coupling type, can be provided.

Even in the present embodiment example, the device 6 comprises transportation means, for example in the form of gripping means such as in particular a lateral handle 9, advantageously with ergonomic shape. The handle 9 is arranged, in the represented example, at an external transverse edge of the platform 70 and visible, for example, in FIGS. 6B and 7A-7B.

Figure 7B:
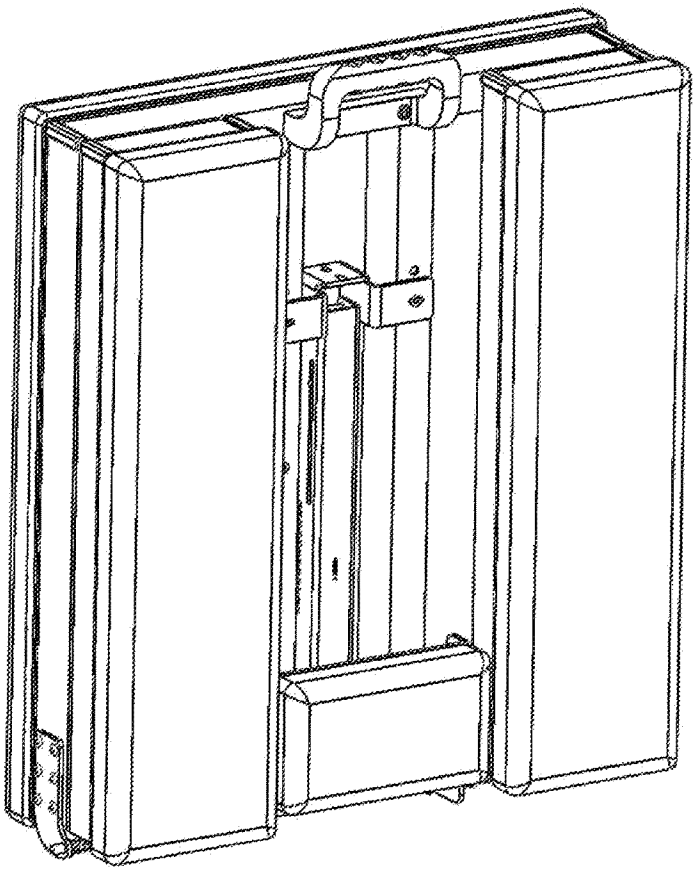
FIGS. 7A and 7B show each one a perspective view of the device of FIG. 6A, during its folding and in a configuration having minimum encumbrance suitable to transportation and storage, respectively.
Figure 7A:
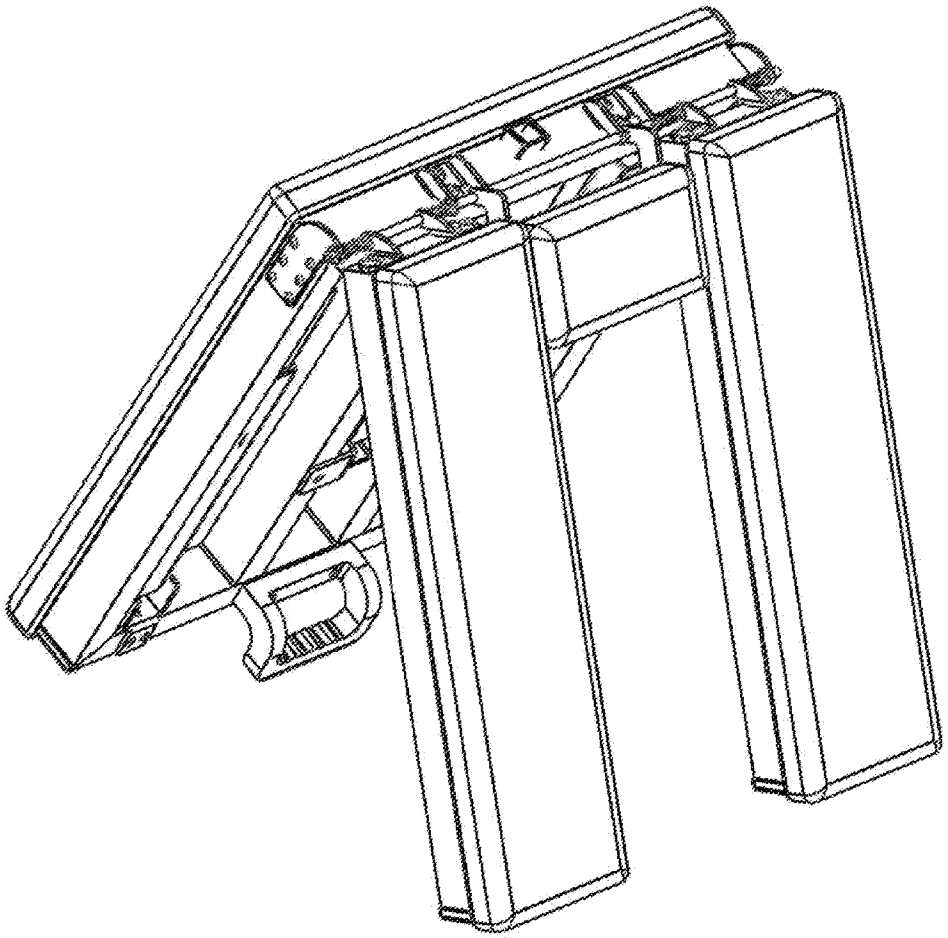

According to an already mentioned preferred embodiment variant, the device 6 is foldable, in order to be transported or placed in a configuration having minimum encumbrance, as exemplified in FIGS. 7A and 7B. In particular, the arms 71 and 72 are revolvingly connected to the platform 70 at respective transverse edges placed side by side to the latter, according to a rotation axis parallel to the transverse direction itself. In particular, as better visible in FIGS. 8B, 9 and 10, the frame structure 727 and 728 are connected to the structure 726 by means of a hinge 90. The latter can be implemented by means of a single transverse pin 91 which engages respective slots or seats of the above-mentioned structures 726, 727 and 728. On the same hinge 90 even the cushion 73 is revolvingly connected, with an analogous coupling of the pin 91 in respective slots or seats.

Figure 10:
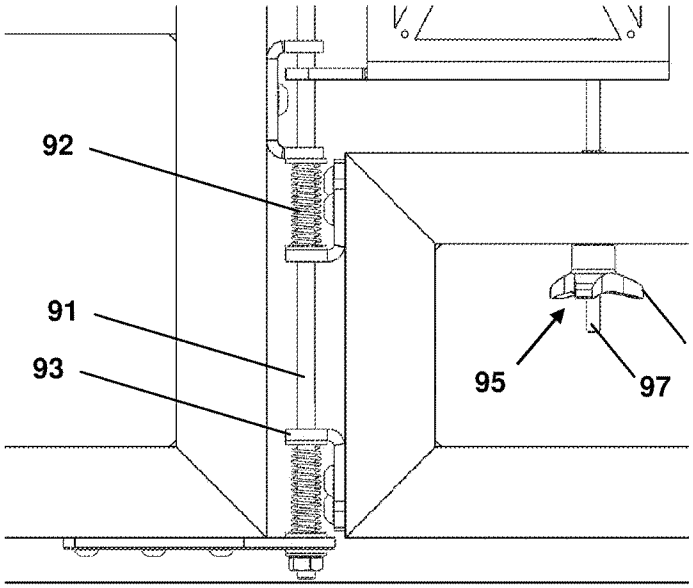
FIG. 10 shows an enlarged detail of FIG. 9.

As it is better appreciated from FIG. 10, said revolving connection between each structure 727 and 728 and the pin 91 is so as to allow a translation of the first ones in transverse direction, that is along the pin 91 itself. Preferably, such sliding connection even provides, for each structure 727, 728, the interposition of elastic contrast elements, in particular a pair of compression springs, one thereof designated by way of example with 92, inserted on the pin itself and cooperating with corresponding flanges of the frame structures, one thereof designated by way of example with 93.

In a preferred embodiment variant, at each structure 727, 728 a knob mechanism 95, or an analogous adjustment element, is further provided, to determine a selective transverse approaching of the structures 727, 728, and then of the arms 71 and 72, to the central cushion 73, that is to allow to adjust the relative transverse position of each arm 71, 72 with respect to the platform 70. In this way, the distance between the arms 71 and 72 can be adapted to the width of the exercise bench which, in use, is interposed therebetween.

In the shown embodiment example, a knob 96 is tightened on a threaded pin 97 passing inside an element of the structure 727, 728 and constrained to the supporting small frame 730. Since the latter is not free to translate along the axis of the hinge 90, it acts as reaction element when the knobs 96 are screwed by pushing the lateral structures 727, 728 against the sides of the bench.

The springs 92 keep the arms 71 and 72 in spaced-apart position and with longitudinal edges aligned with those of the platform 70 when the device 6 is in folded position.

In the folded configuration shown in FIG. 7B, even in this case keeping means, for example of magnetic coupling type, between platform 70 and arms 71, 72 and 73, can be provided.

The present invention has been so far described with reference to preferred embodiments. It is to be means that other embodiments belonging to the same inventive core may exist, as defined by the protective scope of the herebelow reported claims.

The invention claimed is:

1. An adapter device, for use with an exercise bench (P) for weight lifting, the exercise bench having a bench surface (S) configured to support part of a body of an athlete in a lying position, defining a longitudinal direction (L) corresponding to an athlete's height and a transverse direction (T) corresponding to a width of the athlete's body, wherein the adapter device comprises:

a first and a second lateral arm, each one spaced transversely from each other and arranged externally side by side to a respective longitudinal edge of the exercise bench;

a main platform, wherein said first and second lateral arm and said main platform define a supporting surface for the subject's body which is substantially "U" or "C" shaped;

elevation means of said supporting surface, configured to support said first and second lateral arm and said main platform in an elevated position with respect to a walking plane and substantially placed side by side to the bench surface, wherein said supporting surface is configured to receive as rest a lateral part of the subject's torso at said first and second lateral arm and the lower limbs of the latter, at said main platform.

2. The adapter device according to claim 1, wherein said supporting surface is substantially continuous.

3. The adapter device according to claim 1, wherein said main platform has an adjustable longitudinal extension.

4. The adapter device according to claim 3, wherein said adjustable longitudinal extension is an appendix selectively extractable in the longitudinal direction.

5. The adapter device according to claim 1, wherein said elevation means comprises a plurality of supporting legs or uprights.

6. The adapter device according to claim 1, wherein said elevation means comprises a plurality of supporting legs or uprights, each one foldable under said main platform and/or said arms.

7. The adapter device according to claim 1, wherein said elevation means has adjustable height.

8. The adapter device according to claim 7, wherein said elevation means has a telescopic construction.

9. The adapter device according to claim 1, further comprising means for stabilizing the subject's body.

10. The adapter device according to claim 9, wherein said comprising means for stabilizing the subject's body includes one or more belts configured to wrap a pelvis and/or the lower limbs.

11. The adapter device according to claim 1, comprising means for transporting the device itself.

12. The adapter device according to claim 1, wherein said first and second lateral arm and said main platform define a main body of the device which is foldable, so as to assume one or more configurations having minimum encumbrance for transportation and storage.

13. The adapter device according to claim 1, wherein said first and/or second lateral arm and/or said main platform comprise a carrier frame.

14. The adapter device according to claim 1, wherein each one of said first and second arms is articulated on said main platform by means of a connection revolving around a transverse axis.

15. The adapter device according to claim 1, wherein each of said first and second arm is sliding transversely with respect to said main platform for adapting to a size of the exercise bench interposed, in use, between the arms themselves.

16. The adapter device according to claim 15, further comprising a mechanism for adjusting and locking a transverse position of each one of said arms with respect to said main platform.

17. The adapter device according to claim 1, wherein said first and/or second lateral arm and/or said main platform comprise a pair of layers placed vertically side by side.

18. The adapter device according to claim 17, wherein the pair of layers include a structural layer made of wood or metal, and an ergonomic layer interacting with the subject's body.

19. The adapter device according to claim 1, further comprising means for keeping the device in a configuration having minimum encumbrance.

20. A method for carrying out the weight lifting exercise with the arms which uses the adapter device according to claim 1, wherein the athlete lies supine with the body on the exercise bench (P) and said lateral arms and the lower limbs on said main platform.

* * * * *